US010818262B2

(12) United States Patent
Sasaki

(10) Patent No.: US 10,818,262 B2
(45) Date of Patent: Oct. 27, 2020

(54) DISPLAY DEVICE AND METHOD OF INSPECTING DISPLAY DEVICE

(71) Applicant: SHARP KABUSHIKI KAISHA, Sakai, Osaka (JP)

(72) Inventor: Takashi Sasaki, Osaka (JP)

(73) Assignee: SHARP KABUSHIKI KAISHA, Sakai, Osaka (JP)

( * ) Notice: Subject to any disclaimer, the term of this patent is extended or adjusted under 35 U.S.C. 154(b) by 0 days.

(21) Appl. No.: 16/516,606

(22) Filed: Jul. 19, 2019

(65) Prior Publication Data

US 2020/0035186 A1 Jan. 30, 2020

Related U.S. Application Data

(60) Provisional application No. 62/703,073, filed on Jul. 25, 2018.

(51) Int. Cl.
*G09G 3/36* (2006.01)

(52) U.S. Cl.
CPC ... *G09G 3/3685* (2013.01); *G09G 2300/0408* (2013.01)

(58) Field of Classification Search
USPC ..... 345/98
See application file for complete search history.

(56) References Cited

U.S. PATENT DOCUMENTS

| | | | | |
|---|---|---|---|---|
| 2006/0012550 | A1 | 1/2006 | Wang et al. | |
| 2009/0021460 | A1 | 1/2009 | Wang et al. | |
| 2009/0195531 | A1 | 8/2009 | Wang et al. | |
| 2009/0201240 | A1 | 8/2009 | Wang et al. | |
| 2009/0201284 | A1 | 8/2009 | Wang et al. | |
| 2010/0225635 | A1* | 9/2010 | Murahashi | G09G 3/006 345/213 |

FOREIGN PATENT DOCUMENTS

JP 2006-030949 A 2/2006

* cited by examiner

*Primary Examiner* — Amr A Awad
*Assistant Examiner* — Jonathan G Cooper
(74) *Attorney, Agent, or Firm* — ScienBiziP, P.C.

(57) ABSTRACT

A display device includes a display panel, display drivers, an inspection signal output, judgement signal outputs included in the respective display drivers and through which judgement signals generated by the display drivers are output, signal inputs included in at least the display drivers except a most upstream one of the display drivers and through which the judgement signals and the inspection signals are input, switches located between the adjacent display drivers in an upstream and downstream direction to cascade the display drivers and each configured to switch points connected to the signal input of one of the display drivers on a downstream side between the judgement signal output of one of the display drivers on an upstream side and the inspection signal output, and a judgement unit connected at least to the judgment signal output of a most downstream one of the display drivers to receive the judgement signal.

7 Claims, 12 Drawing Sheets

DISPLAY DEVICE AND METHOD OF INSPECTING DISPLAY DEVICE

CROSS REFERENCE TO RELATED APPLICATION

This application claims priority from U.S. Provisional Patent Application No. 62/703,073 filed on Jul. 25, 2018. The entire contents of the priority application are incorporated herein by reference.

TECHNICAL FIELD

The technology described herein relates to a display device and a method of inspecting a display device.

BACKGROUND ART

An example of a known display device is described in Japanese Unexamined Patent Application Publication No. 2006-30949. The display device includes a timing controller, multiple driver chips, and a display panel. The driver chips are cascaded together to drive the display panel to display frames. The driver chip includes a differential receiver, a single-ended receiver, a shift register, a differential transmitter, a single-ended transmitter, and a pixel driver. The driver chip receives a pixel signal and drives the display panel according to the pixel signal, and outputs the pixel signal to the next driver chip.

The display device was developed to prevent attenuation of pixel signals in transmission to increase the transmitting clock rate. However, there has been no description about a method of detecting a defective driver chip, such as an improperly mounted driver chip or a disconnected driver chip, which may be included in the multiple driver chips. Thus, it is difficult to identify the defective one from the multiple driver chips and is troublesome.

SUMMARY

The technology described herein was made in view of the above-described circumstance. An object thereof is to identify a defective display driver.

A display device according to the technology described herein includes a display panel configured to display an image, display drivers configured to drive the display panel, an inspection signal output configured to output an inspection signal for inspecting the display drivers, judgement signal outputs included in the respective display drivers and through which judgement signals generated by the display drivers are output, signal inputs included in at least the display drivers except a most upstream one of the display drivers and through which the judgement signals and the inspection signals are input, switches located between the display drivers adjacent to each other in an upstream and downstream direction to cascade the display drivers and each configured to switch points connected to the signal input of one of the display drivers on a downstream side between the judgement signal output of one of the display drivers on an upstream side and the inspection signal output, and a judgement unit connected at least to the judgment signal output of a most downstream one of the display drivers to receive the judgement signal.

Furthermore, a method of inspecting a display device including at least a display panel that displays an image and display drivers that drive the display panel. The method includes a first inspection process including generating a judgement signal in sequence at each of the display drivers with switches that are located between the display drivers adjacent to each other in an upstream and downstream direction to cascade the display drivers being set such that signal inputs of at least the display drivers except a most upstream one of the display drivers are connected to judgement signal outputs of the display drivers through which the judgement signals generated at the display drivers are output and determining whether the display drivers include a defective one based on whether a judgement unit connected at least to the judgment signal output of a most downstream one of the display driver receives the judgment signal, and a second inspection process of identifying the defective display driver if it is determined that the display drivers include a defective one in first inspection process, the second inspection process including supplying an inspection signal from an inspection signal output to the signal input of one of the display drivers to be inspected, with one of the switches corresponding to the display driver to be inspected being set such that the inspection signal output configured to output an inspection signal is connected to the signal input of the display driver to be inspected and the other switches corresponding to the display drivers not to be inspected being set such that the judgement signal outputs are connected to the signal inputs of the display drivers not to be inspected, such that the judgement signal is output from the judgement signal output of the display driver being inspected in response to the inspection signal, generating a judgement signal in sequence at each of the other display drivers on a downstream side of the display driver to be inspected in response to the judgement signal, and identifying the defective one of the display drivers based on whether the judgement unit receives the judgment signal at least from the judgement signal output of the most downstream one of the display drivers.

According to the technology described herein, the defective display driver is identified.

DETAILED DESCRIPTION

First Embodiment

A first embodiment is described with reference to FIG. 1 to FIG. 5. In this embodiment, a liquid crystal display device (display device) 10 including a liquid crystal panel (display panel) 11 is described as an example. The X axis, the Y axis, and the Z axis are indicated in some of the drawings, and each of the axes indicates the same direction in the respective drawings.

Figure 1:
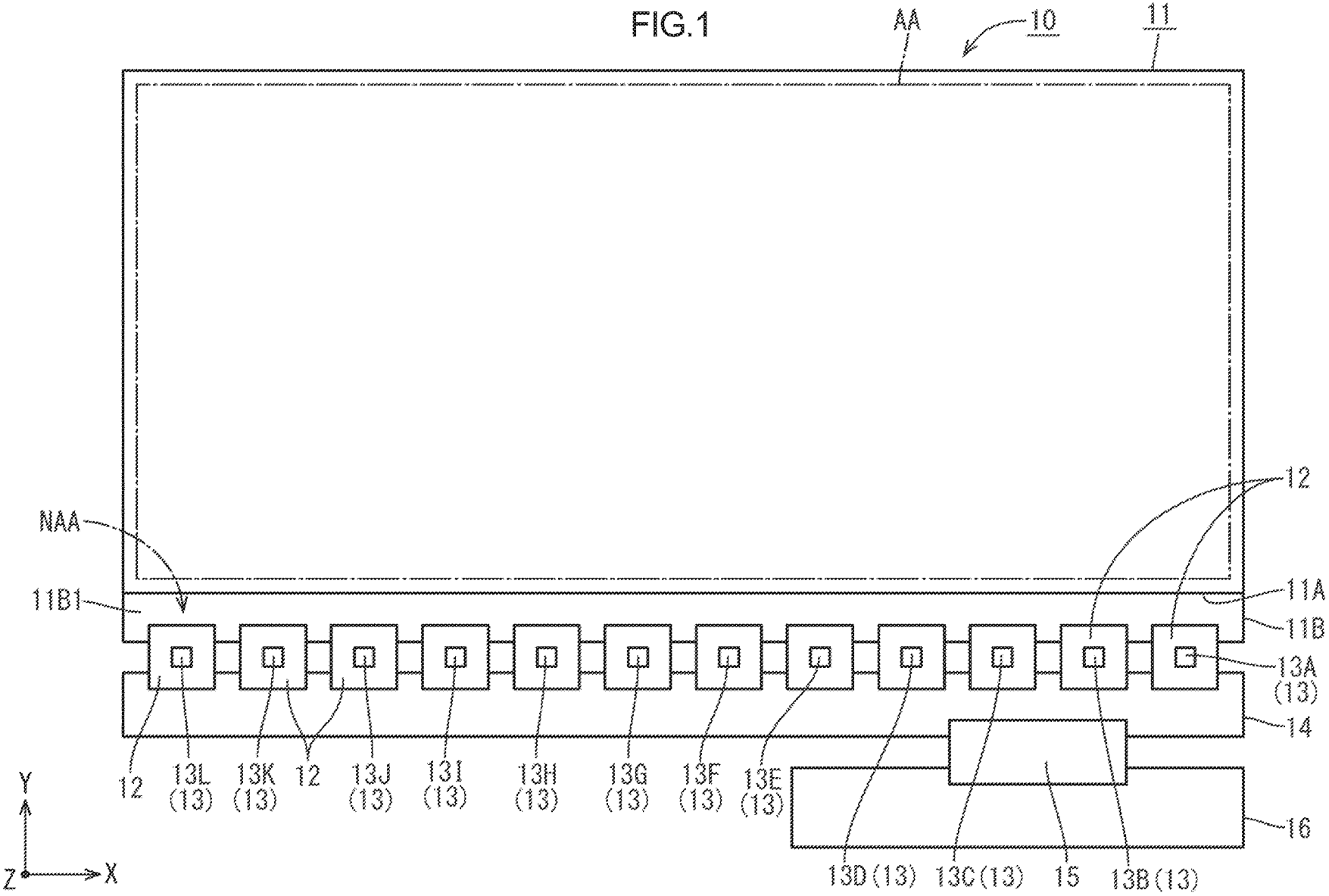
FIG. 1 is a plan view illustrating a liquid crystal panel, a flexible board, a driver, a printed circuit board, a board-to-board cable, and a control board, which are included in a liquid crystal display device according to a first embodiment.

The liquid crystal display device 10 at least includes a liquid crystal panel 11 that displays an image and a backlight device (lighting device) that applies display light to the liquid crystal panel 11. As illustrated in FIG. 1, the liquid crystal panel 11 has a display area (active area) AA capable of displaying an image at a middle of the screen and a non-display area (non-active area) NAA not capable of displaying an image at an outer periphery of the screen. The non-display area NAA surrounds the display area AA and has a frame-like shape in a plan view. In this embodiment, the long-side direction of the liquid crystal panel 11 matches the X axis direction in the drawings, the short-side direction matches the Y axis direction in the drawings, and the thickness direction matches the Z axis direction. In FIG. 1, an area enclosed by a one-dot chain line is the display area AA. The liquid crystal panel 11 includes substantially transparent (light-transmitting) two glass substrates 11A and 11B and a liquid crystal layer sandwiched therebetween. The liquid crystal layer contains liquid crystal molecules whose optical properties are changed by application of an electrical field. One of the substrates on the front side (front surface side) is a CF substrate (counter substrate) 11A and one on the rear side (rear surface side) is an array substrate (active matrix substrate) 11B. The short side of the CF substrate 11A is shorter than that of the array substrate 11B. The CF substrate 11A and the array substrate 11B are attached to each other with the sides at one end in the short-side direction or the Y axis direction (the upper sides in FIG. 1) being put together. Thus, a portion of the array substrate 11B around a side at the other end in the short-side direction or the Y axis direction (the lower side in FIG. 1) is a CF substrate non-overlapping portion 11B1 that does not have the CF substrate 11A.

Figure 3:
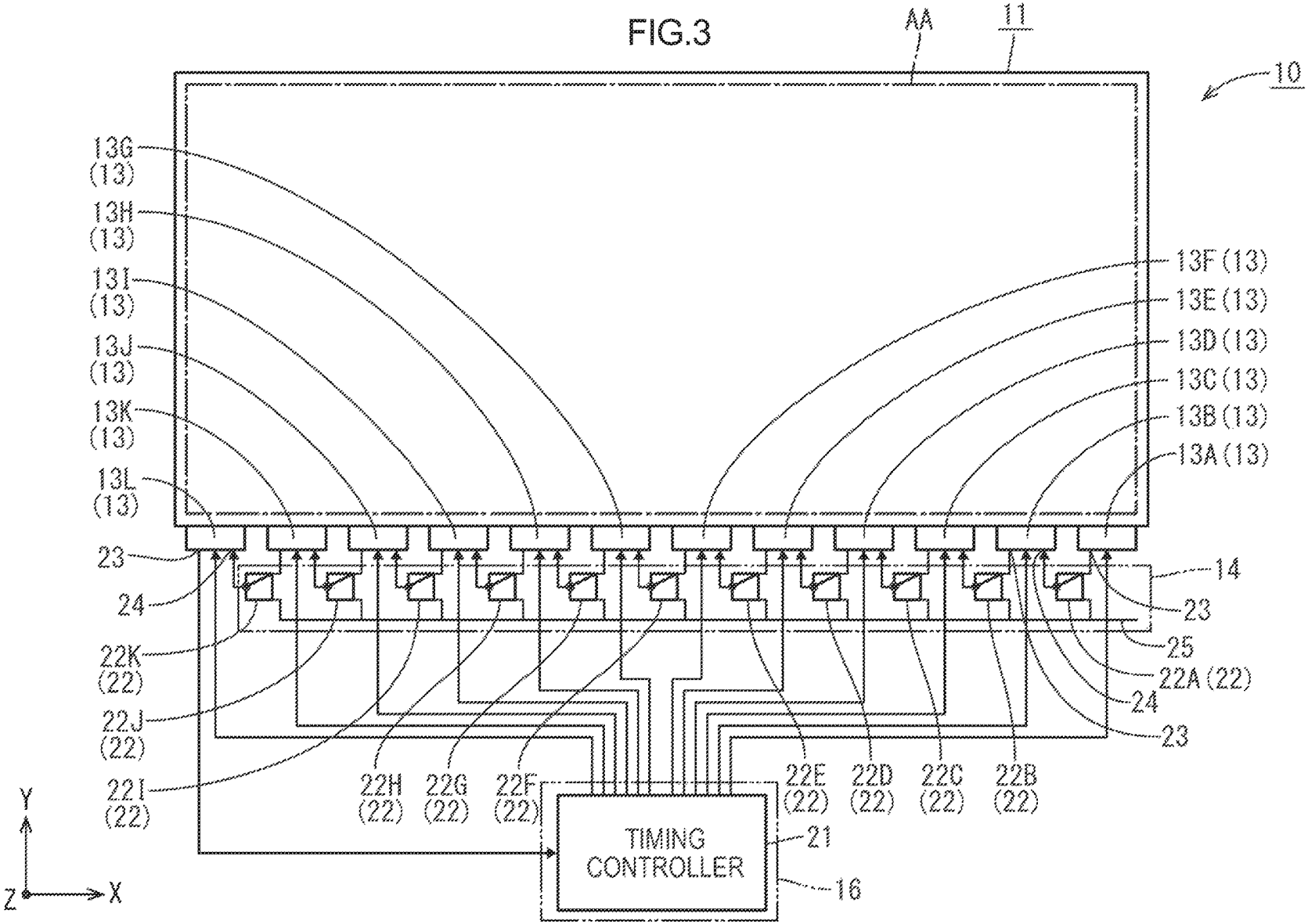
FIG. 3 illustrates an electrical connection between drivers included in the liquid crystal display device.

As illustrated in FIG. 1, the flexible boards 12 are each connected to the CF substrate non-overlapping portion 11B1 of the array substrate 11B at one end. The flexible board 12, which includes a film-like substrate formed of a synthetic resin (polyimide resin, for example), is flexible and has a driver (display driver) 13 and multiple wiring patterns on the substrate. The flexible boards 12 (twelve flexible boards 12 in this embodiment) and the drivers 13 (twelve drivers 13 in this embodiment) are arranged in a straight line extending in the X axis direction. The drivers 13 are mounted on the flexible boards 12 by using Chip-On-Film (COF) technology. The driver 13 includes an LSI chip having a driving circuit therein. The driver 13 processes various signals and outputs the signals to the liquid crystal panel 11 to drive the liquid crystal panel 11. In the arrangement of the drivers 13, the right side in the X axis direction in FIG. 3 is referred to as an "upstream side" and the left side in FIG. 3 is referred to as a "downstream side". The drivers 13 arranged in the X axis direction are each responsible for driving of a band-like region of the display area AA of the liquid crystal panel 11 having a predetermined width in the X axis direction. Specifically described, the long-side dimension of the display area AA is divided by the number of drivers 13, and the obtained dimension is the width of the band-like region allocated to one driver 13. The drivers 13 are responsible for driving of the respective band-like regions. The flexible boards 12 are each connected to the printed circuit board 14 extending in the X axis direction at the other end. A board-to-board connection cable (connector) 15 is connected to the printed circuit board 14 at one end and connected to a control board 16, which is a signal source, at the other end. The various signals from the control board 16 are transmitted through the board-to-board connection cable 15 and the printed circuit board 14 to the flexible boards 12 where the signals are processed by the drivers 13, and then the signals are output to the liquid crystal panel 11. The board-to-board connection cable 15 preferably has flexibility as the flexible board 12.

Figure 2:
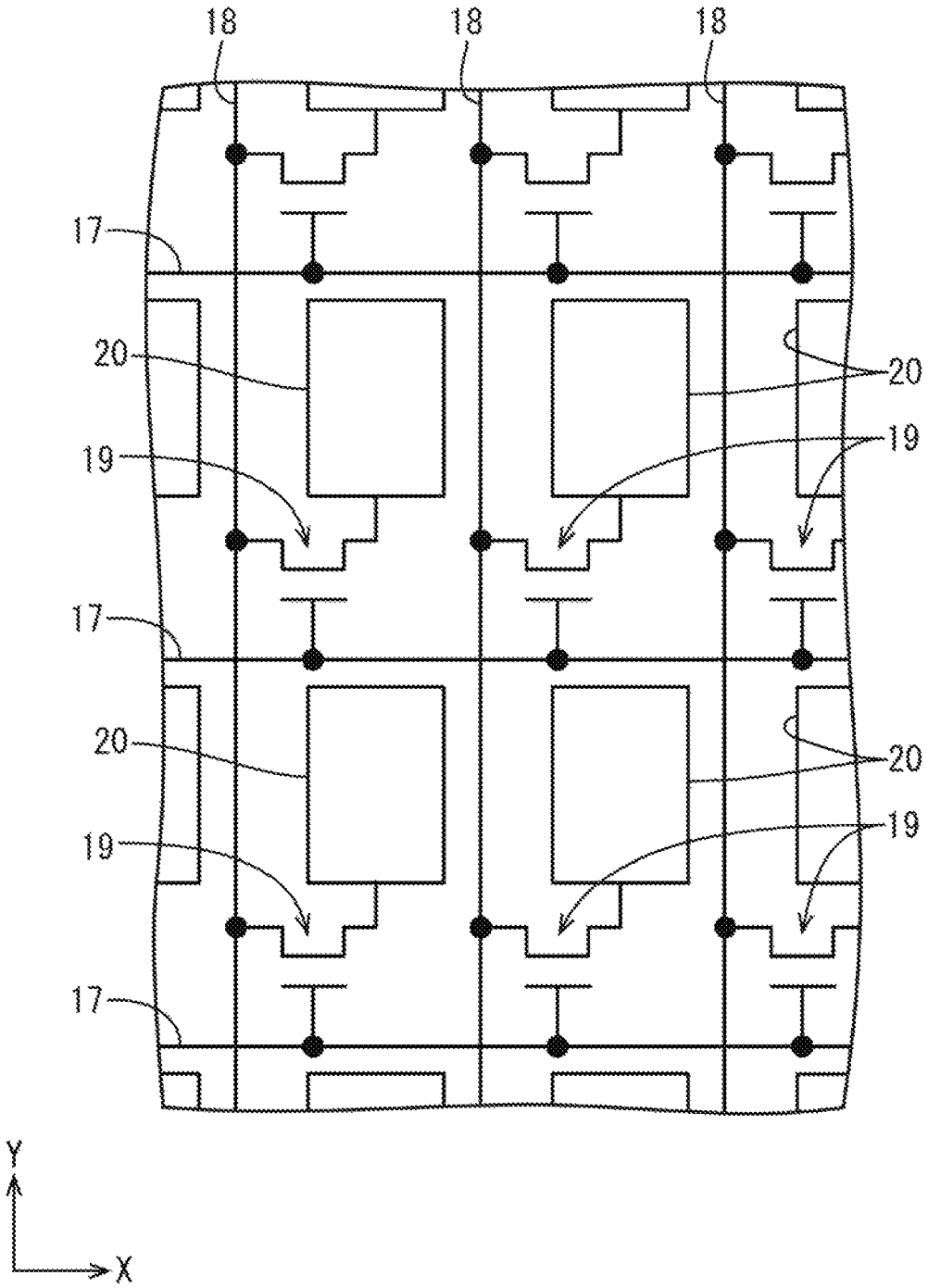
FIG. 2 is a circuit diagram indicating a pixel array in a display area of an array substrate included in the liquid crystal panel of the liquid crystal display device.

As illustrated in FIG. 2, multiple gate lines (scanning lines) 17 and multiple source lines (signal lines, date lines) 18 are disposed in a grid pattern on the inner surface of the array substrate 11B over the display area AA. TFTs 19, which are switching devices, and pixel electrodes 20 are disposed near the intersections of the lines. The gate lines 17 extend in the X axis direction across the display area AA and are connected to gate electrodes of the TFTs 19. The source lines 18 extend in the Y axis direction across the display area AA and are connected to source electrodes of the TFTs 19. The gate lines 17 are spaced apart from each other in the Y axis direction. The source lines 18 are spaced apart from each other in the X axis direction. The gate lines 17 and the source lines 18 receive various signals from the drivers 13. The TFTs 19 and the pixel electrodes 20 are arranged in the X axis direction and the Y axis direction in a matrix (rows and columns) in a plane. The pixel electrodes 20 are connected to drain electrodes of the TFTs 19. The TFTs 19 are driven in response to scanning signals supplied to the gate lines 17 and the pixel electrodes 20 are charged to a potential corresponding to the image signal (signal, data signal) supplied to the source line 18 in accordance with the driving. In contrast, red (R), green (G), and blue (B) color filters and light-blocking portions (black matrix) located between the color filters, for example, are disposed on the inner surface of the CF substrate 11A over the display area AA to overlap the pixel electrodes 20. In the liquid crystal panel 11, the R, G, and B color filters arranged in the X axis direction and three-pixel electrodes 20 facing the color filters constitute pixels of three colors. The pixels are arranged in the X axis direction and the Y axis direction in a matrix. Furthermore, a common electrode, which is formed of a transparent electrode material as the pixel electrodes 20, is disposed on one of the CF substrate 11A and the array substrate 11B to overlap the pixel electrodes 20 with a distance from the pixel electrodes 20. In the liquid crystal panel 11, a predetermined electrical filed is applied to the liquid crystal layer based on a potential difference between the common electrode and the pixel electrodes 20, enabling the pixels to provide a predetermined gray scale display.

The following is a description of a configuration for determining whether the drivers 13 have a defect, such as improper mounting and disconnection. The phrase "defect in the driver 13" refers not only to improper mounting of the driver 13 on the flexible board 12 and disconnection in the circuit of the driver 13 but also to improper mounting of the flexible board 12 on the liquid crystal panel 11 or on the printed circuit board 14 and wiring disconnection on the flexible board 12. In short, the driver 13 that is not capable of driving the liquid crystal panel 11 is referred to as a "defective driver 13". First, as illustrated in FIG. 3, the control board 16 includes a timing controller (judgement unit) 21 that generates various signals to be sent to the drivers 13. The timing controller 21 includes an LSI chip, for example. In FIG. 3, routes of signals from the timing controller 21 to the drivers 13 are indicated by arrows (twelve arrows) arranged in a spread fan-like shape.

Hereinafter, when the drivers 13 need to be distinguished from each other, the most upstream (first) one is referred to as a "first driver" and the reference numeral has a suffix "A", the second one from the most upstream one is referred to as a "second driver" and the reference numeral has a suffix "B", the third one is referred to as a "third driver" and the reference numeral has a suffix "C", the fourth one is referred to as a "fourth driver" and the reference numeral has a suffix "D", the fifth one is referred to as a "fifth driver" and the reference numeral has a suffix "E", the sixth one is referred to as a "sixth driver" and the reference numeral has a suffix "F", the seventh one is referred to as a "seventh driver" and the reference numeral has a suffix "G", the eighth one is referred to as an "eighth driver" and the reference numeral has a suffix "H", the ninth one is referred to as a "ninth driver" and the reference numeral has a suffix "I", the tenth one is referred to as a "tenth driver" and the reference numeral has a suffix "J", the eleventh one is referred to as an "eleventh driver" and the reference numeral has a suffix "K", and the most downstream (twelfth) one is referred to as a "twelfth driver" and the reference numeral has a suffix "L". When the drivers 13 are collectively referred without being distinguished from each other, the reference numerals do not have the suffixes.

As illustrated in FIG. 3, the drivers 13 arranged in the X axis direction are cascaded by switches 22 included in the printed circuit board 14 on which the flexible boards 12 including the drivers 13 are mounted. The switches 22 are located between the drivers 13 adjacent to each other in an upstream and downstream direction and are each connected to a judgement signal output 23 of the driver 13 on an upstream side, a signal input 24 of the driver 13 on a downstream side, and an inspection signal output 25 of the printed circuit board 14. The number of switches 22 is smaller than the number of drivers 13 by one. The switches 22 are single pole double throw switches each having a common contact, a contact a, a contact b, which are respectively connected to the signal input 24, the inspection signal output 25, and the judgement signal output 23. In this configuration, the switch 22 in a non-operating state (initial state) allows electrical connection between the signal input 24, which is connected to the common contact, and the judgement signal output 23, which is connected to the contact b. When the switch 22 is changed from the initial state to an operating state, the switch 22 changes the point to be connected to the signal input 24, which is connected to the common contact, to allow electrical connection between the signal input 24, which is connected to the common contact, and the inspection signal output 25, which is connected to the contact a. In other words, the switch 22 is configured to switch points to be connected to the signal input 24 of the downstream driver 13 between the judgement signal output 23 of the upstream driver 13 and the inspection signal output 25. The judgement signal output 23 through which a judgement signal generated by the driver 13 is output is included in each of the drivers 13. The signal input 24, which receives various signals (judgement signal and inspection signal) supplied to the driver 13, is included in all the drivers 13B to 13L except the most upstream first driver 13A. In other words, the signal inputs 24 are selectively included in all the drivers 13B to 13L except the most upstream one. The judgement signal output 23 and the signal input 24 are respectively connected to the contact b and the common contact of the switch 22 through the wiring line on the flexible board 12 and the printed circuit board 14, for example. The inspection signal output 25 outputs an inspection signal for inspecting the driver 13. The inspection signal may be generated by the circuit of the inspection signal output 25 or may be supplied by the timing controller 21 to the inspection signal output 25. The inspection signal output 25 extends across the arrangement area of the switches 22 on the printed circuit board 14 and branches to the switches 22. The branches are connected to the contacts a of the switches 22. The timing controller 21 of this embodiment is connected to the judgement signal output 23 of the twelfth driver 13L, which is the most downstream driver 13, to receive the judgement signal generated by the twelfth driver 13L. In particular, the judgement signal output 23 of the twelfth driver 13L, which is the most downstream driver 13, is selectively connected to the timing controller 21 in this embodiment. The timing controller 21 controls driving of the drivers 13 based on whether the timing controller 21 receives the judgement signal from the judgement signal output 23 of the most downstream twelfth driver 13L.

Hereinafter, when the switches 22 need to be distinguished from each other, one between the first driver 13A and the second driver 13B is referred to as a "first switch" and the reference numeral has a suffix "A", one between the second driver 13B and the third driver 13C is referred to as a "second switch" and the reference numeral has a suffix "B", one between the third driver 13C and the fourth driver 13D is referred to as a "third switch" and the reference numeral has a suffix "C", one between the fourth driver 13D and the fifth driver 13E is referred to as a "fourth switch" and the reference numeral has a suffix "D", one between the fifth driver 13E and the sixth driver 13F is referred to as a "fifth switch" and the reference numeral has a suffix "E", one between the sixth driver 13F and the seventh driver 13G is referred to as a "sixth switch" and the reference numeral has a suffix "F", one between the seventh driver 13G and the eighth driver 13H is referred to as a "seventh switch" and the reference numeral has a suffix "G", one between the eighth driver 13H and the ninth driver 13I is referred to as an "eighth switch" and the reference numeral has a suffix "H", one between the ninth driver 13I and the tenth driver 13J is referred to as a "ninth switch" and the reference numeral has a suffix "I", one between the tenth driver 13J and the eleventh driver 13K is referred to as a "tenth switch" and the reference numeral has a suffix "J", and one between the eleventh driver 13K and the twelfth driver 13L is referred to as an "eleventh switch" and the reference numeral has a suffix "K". When the switches 22 are collectively referred without being distinguished from each other, the reference numerals do not have the suffixes.

The liquid crystal display device 10 according to the embodiment has the above-described structure. Next, a method of inspecting the liquid crystal display device 10 is described. The method of inspecting the liquid crystal display device 10 includes a first inspection process of determining whether the drivers 13 of the liquid crystal display device 10 includes a defective driver and a second inspection process of identifying the defective driver 13.

In the first inspection process, as illustrated in FIG. 3, each of the switches 22 is set such that the common contact (signal input 24) is connected to the contact b (judgement signal output 23). In such a state, a judgement signal generated by the first driver 13A, which is the most upstream one of the drivers 13, is output through the judgement signal output 23 of the most upstream first driver 13A to the signal input 24 of the next second driver 13B through the first switch 22A. When the judgement signal is input into the signal input 24 of the second driver 13B, the second driver 13B generates a judgement signal. The judgement signal is output through the judgement signal output 23 of the second driver 13B. If all the drivers 13, which are cascaded by the switches 22, are free from defects, a repetition of the above-described inputting of a judgement signal, generation of a judgement signal, and outputting of the judgement signal ends up in outputting of a judgement signal from the judgment signal output 23 of the most downstream twelfth driver 13L to the timing controller 21. In contrast, if the drives 13 include a defective one, the defective driver 13 does not output the judgement signal, and thus the judgement signal is not input to the signal input 24 of the driver 13 on the downstream side of the defective driver 13 (including the most downstream twelfth driver 13L). The driver(s) 13 on the downstream side of the defective driver 13 do not generate a judgement signal and not output a judgement signal through the judgement signal output(s) 23. Thus, the timing controller 21 does not receive a judgment signal. Based on this, the timing controller 21 determines that the drivers 13 do not include a defective driver when the timing controller 21 receives the judgement signal from the most downstream twelfth driver 13L and determines that the drivers 13 include a defective driver when the timing controller 21 does not receive the judgement signal.

When a defective driver 13 is detected in the first inspection process, the second inspection process is performed next. The second inspection process is sequentially performed in descending order from the most upstream first driver 13A. In the second inspection process, the switch 22 for the driver 13 to be inspected is set such that the common contact, which is connected to the signal input 24 of the driver 13 to be inspected, is connected to the contact a (inspection signal output 25), and the switches 22 of the drivers 13 not to be inspected are set such that the common contacts, which are connected to the signal inputs 24 of the drivers 13, are connected to the contacts b (judgement signal outputs 23). Specifically described, for example, when the first driver 13A is inspected, the first switch 22A is set such that the contact a (inspection signal output 25) is connected to the common contact connected to the signal input 24 of the first driver 13A and the other switches 22B to 22K are each in the initial state (the contact b is connected to the common contact). In such a state, an inspection signal from the inspection signal output 25 is input to the signal input 24 of the driver 13 being inspected through the switch 22. At this time, if the driver 13 being inspected does not have a defect and the other drivers 13 on the downstream side of the driver 13 being inspected do not have a defect, the drivers 13 each generate a judgement signal, and thus the most downstream twelfth driver 13L outputs a judgement signal through the judgement signal output 23. Although the driver 13 being inspected does not have a defect and outputs a judgement signal through the judgement signal output 23 thereof, the other drivers 13 on the downstream side of the inspected driver 13 may include a defective driver. In such a case, the defective driver 13 does not generate a judgement signal and the driver(s) 13 (including the most downstream twelfth driver 13L) on the downstream side of the defective driver do not output a judgement signal through the judgement signal output(s) 23 thereof. Furthermore, when the driver 13 being inspected has a defect, the defective driver 13 does not output a judgement signal through the judgement signal output 23 thereof, and the other driver(s) 13 (including the most downstream twelfth driver 13L) on the downstream side of the defective driver do not output a judgement signal through the judgement signal output(s) 23 thereof.

Figure 4:
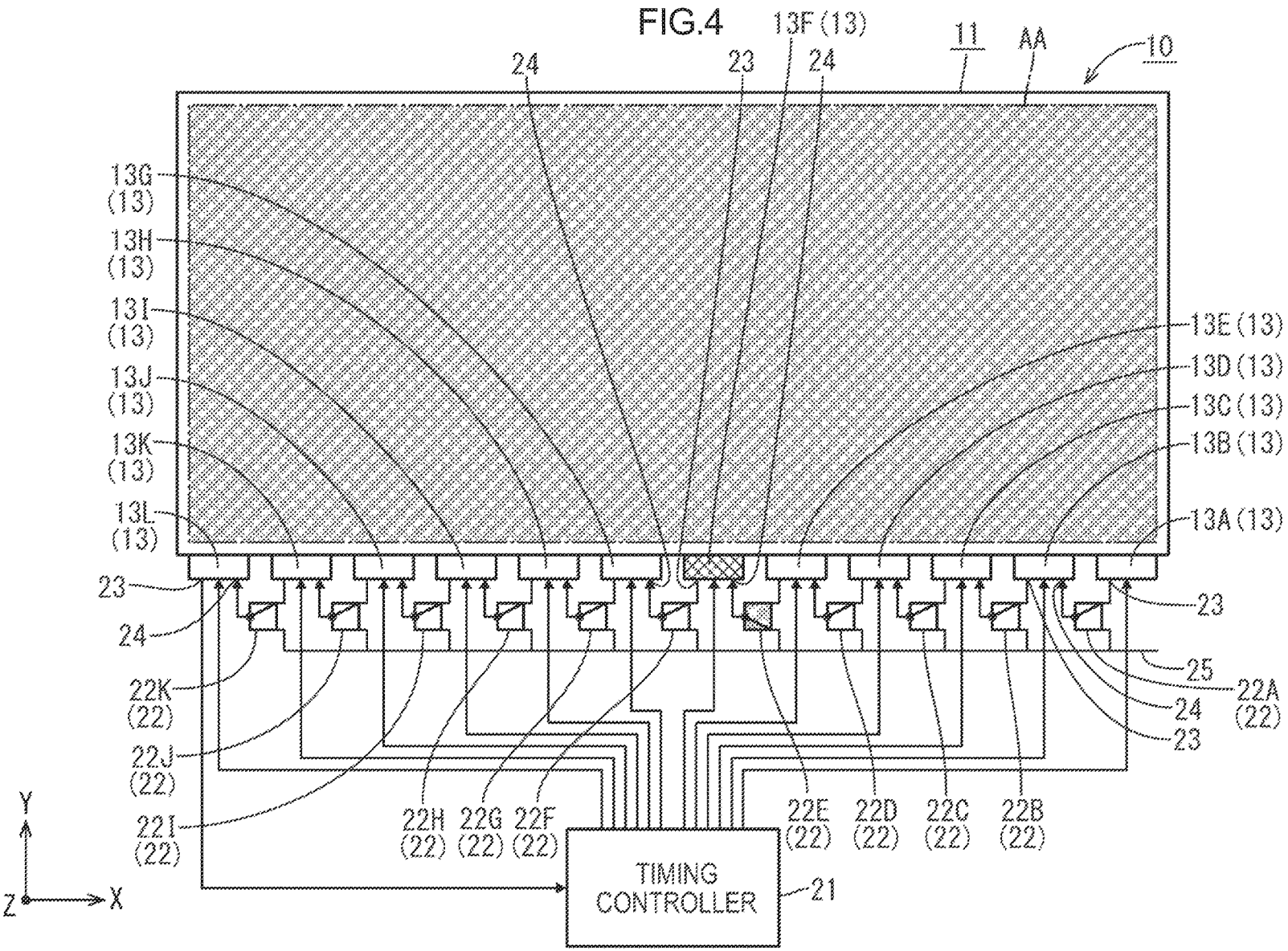
FIG. 4 illustrates how a defective driver is inspected in a second inspection process included in a method of inspecting a liquid crystal display device.
Figure 5:
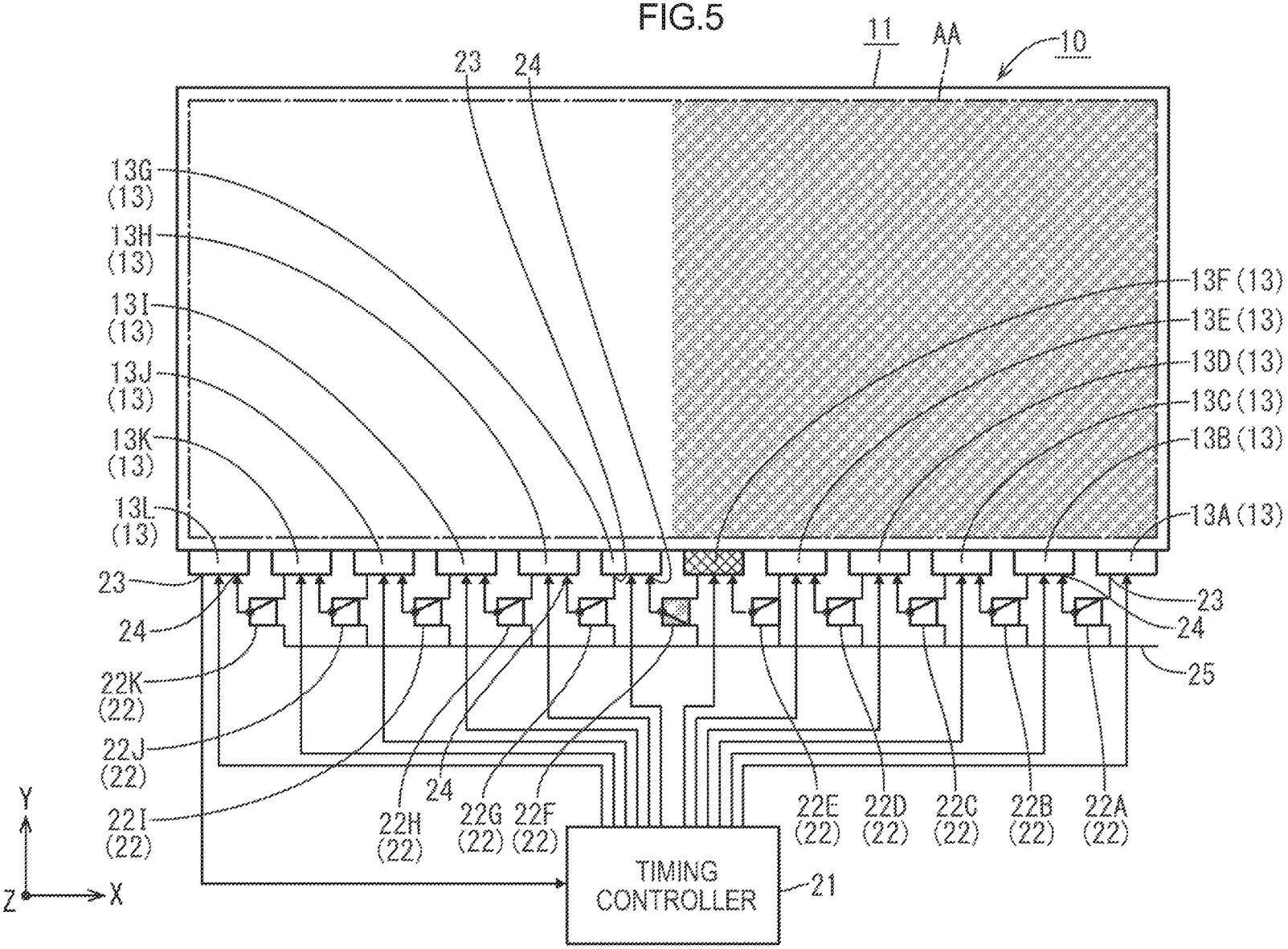
FIG. 5 illustrates how drivers on a downstream of the defective driver are inspected in the second inspection process included in the method of inspecting a liquid crystal display device.

The second inspection process is described in more detail. In this example, only the sixth driver 13F has a defect as illustrated in FIG. 4 and FIG. 5. In FIG. 4 and FIG. 5, the defective driver 13 is shaded and the switch 22 in an operating state (not in the initial state) is shaded in a different way from the defective driver 13. Furthermore, in FIG. 4 and FIG. 5, a portion of the display area AA of the liquid crystal panel 11 providing a white display is outlined in white and a portion of the display area AA providing a black display is shaded. As illustrated in FIG. 4, in the second inspection process for the sixth driver 13F, the fifth switch 22E is set such that the contact a (inspection signal output 25) is connected to the common contact, which is connected to the signal input 24 of the sixth driver 13F, and the other switches 22A to 22D and 22F to 22K are in the initial state. In such a state, although the inspection signal from the inspection signal output 25 is input to the signal input 24 of the sixth driver 13F through the contact a of the fifth switch 22E and the common contact, the sixth driver 13F does not generate a judgement signal. Thus, judgement signals are not output through the judgement signal outputs 23 of the other subsequent drivers, i.e., the seventh to twelfth drivers 13G to 13L. When the first to fifth drivers 13A to 13E on the upstream side of the sixth driver 13F are inspected in the second inspection process, the first to fifth drivers 13A to 13E, which do not have a defect generate judgement signals and the judgement signals are output through the judgement signal outputs 23 of the drivers 13A to 13E. However, the defective sixth driver 13F on the downstream side of the drivers 13A to 13E does not generate a judgement signal. Thus, judgement signals are not output through the judgement signal outputs 23 of the other subsequent drivers, i.e., the seventh to twelfth drivers 13G to 13L. As described above, the timing controller 21 does not receive a judgement signal when the second inspection process is performed on the first driver 13A to the defective sixth driver 13F. The timing controller 21 does not supply various display signals to all the drivers 13, and thus the entire display area AA of the liquid crystal panel 11 provides a black display.

In contrast, as illustrated in FIG. 5, in the second inspection process for the seventh driver 13G, the sixth switch 22F is set such that the contact a (inspection signal output 25) is connected to the common contact, which is connected to the signal input 24 of the seventh driver 13G, and the other switches 22A to 22E and 22G to 22K are in the initial state. In such a state, when the inspection signal from the inspection signal output 25 is input to the signal input 24 of the seventh driver 13G through the contact a and the common contact of the sixth switch 22F, the seventh driver 13G generates a judgement signal. The judgement signal is output through the judgement signal output 23 of the seventh driver 13G, and the judgement signal is input into the signal input 24 of the eighth driver 13H through the next seventh switch 22G. The seventh to twelfth drivers 13G to 13L, which do not have a defect, each generate a judgement signal. The judgement signals are output through the judgement signal outputs 23 of the drivers 13G to 13L. Thus, the timing controller 21 receives the judgement signal from the judgement signal output 23 of the twelfth driver 13L. The timing controller 21 that has received the judgement signal supplies various display signals to the seventh to twelfth drivers 13G to 13L, which generated the judgement signals. Thus, a portion of the display area AA allocated to the seventh to twelfth drivers 13G to 13L (about a left half in FIG. 5) selectively provides a white display. A portion of the display area AA allocated to the defective sixth driver 13F and the drivers 13A to 13E on the upstream side of the sixth driver 13F (about a right half in FIG. 5) keeps providing a black display. As described above, the operator is able to identify the defective driver 13 by checking the portion of the display area AA that provides a white display.

As described above, the liquid crystal display device (display device) 10 of the present embodiment includes the liquid crystal panel (display panel) 11 that displays an image, the drivers (display drivers) 13 that drive the liquid crystal panel 11, the inspection signal output 25 that outputs the inspection signal for inspecting the drivers 13, the judgment signal outputs 23 included in the respective drivers 13 and through which the judgement signals generated by the drivers 13 are output, the signal inputs 24 included in at least all the drivers 13 except the most upstream one of the drivers 13 and through which the judgement signals and the inspection signals are input, the switches 22 located between the drivers 13 adjacent to each other in an upstream and downstream direction to cascade the drivers 13 and each configured to switch points connected to the signal input 24 of one of the drivers 13 on a downstream side between the judgement signal output 23 of the one of the drivers 13 on an upstream side and the inspection signal output 25, and the timing controller (judgement unit) 21 connected at least to the judgement signal output 23 of the most downstream twelfth driver 13L to receive the judgement signal.

By using this configuration, the inspection is performed to detect a defective driver 13. First, all the switches 22 are set such that the signal inputs 24 are connected to the judgment signal outputs 23. When the most upstream first driver 13A of the drivers 13 generates a judgement signal, the judgement signal is output through the judgement signal output 23 of the most upstream first driver 13A to the signal input 24 of the next second driver 13B through the first switch 22A. When the second driver 13B receives the judgement signal at the signal input 24, the second driver 13B generates a judgement signal and outputs the judgement signal through the judgement signal output 23. If all the drivers 13, which are cascaded by the switches 22, are free from defects, the most downstream twelfth driver 13L outputs the judgement signal to the timing controller 21. If the drivers 13 include a defective one, the most downstream twelfth driver 13L does not output a judgement signal, and thus the timing controller 21 does not receive a judgement signal. The timing controller 21 determines that the drivers 13 do not include a defective one when the timing controller 21 receives a judgement signal and determines that the drivers 13 include a defective one when the timing controller 21 does not receive a judgement signal.

Next, an inspection for identifying the defective driver 13 is described. First, the switch 22 for the driver 13 to be inspected is set such that the inspection signal output 25 is connected to the signal input 24 of the driver 13 to be inspected and the switches 22 for the drivers 13 not to be inspected are set such that the judgment signal outputs 23 are connected to the signal inputs 24 of the drivers 13 not to be inspected. In such a state, an inspection signal is sent from the inspection signal output 25 to the signal input 24 of the driver 13 to be inspected. At this time, if the driver 13 being inspected and all the other drivers 13 on the downstream side of the driver 13 being inspected are free from defects, each of the drivers 13 generates a judgement signal. Thus, the most downstream twelfth driver 13L outputs a judgement signal through the judgement signal output 23. Although the driver 13 being inspected does not have a defect and outputs the judgement signal through the judgement signal output 23 thereof, one of the drivers 13 on the downstream side of the inspected driver 13 may have a defect. In such a case, a judgement signal is not output through the judgement signal output 23 of the most downstream twelfth driver 13L. Furthermore, when the driver 13 being inspected has a defect, the defective driver 13 does not output a judgement signal through the judgement signal output 23, and the most downstream twelfth driver 13L does not output a judgement signal through the judgement signal output 23. In this configuration, the above-described inspection is sequentially performed in descending order from the most upstream first driver 13A, for example, and when the timing controller 21 receives a judgement signal from the judgement signal output 23 of the most downstream twelfth driver 13L during inspection of one of the drivers 13, it is determined that the driver 13 on the upstream side of the inspected driver 13 has a defect. In this way, a defective driver 13 in the drivers 13 is identified.

Furthermore, the judgement signal output 23 of the twelfth driver 13L, which is the most downstream driver 13 of the drivers 13, is selectively connected to the timing controller 21. This is a simpler connection structure than the structure in which the judgement signal outputs 23 of all the drivers 13 are connected to the timing controller 21.

Furthermore, the timing controller 21 controls driving of the drivers 13 based on whether the timing controller 21 receives the judgement signal from the judgement signal output 23 of the twelfth driver 13L, which is the most downstream driver 13. With this configuration, when the timing controller 21 receives a judgement signal from the judgement signal output 23 of the most downstream twelfth driver 13L, the timing controller 21 drives one or more of the drivers 13 that generated the judgement signal(s) to display an image on the liquid crystal panel 11 over a specific area by the driver(s) 13. In contrast, if a judgement signal is not output from the judgement signal output 23 of the most downstream twelfth driver 13, the timing controller 21 does not receive a judgement signal, and thus the timing controller does not drive all the drivers 13. In such a case, the liquid crystal panel 11 does not display an image. As described above, the operator is able to determine whether the drivers 13 include a defective one based on whether an image is displayed on the liquid crystal panel 11 and is able to identify the defective driver 13 based on the area of the image displayed on the liquid crystal panel 11.

Furthermore, the signal inputs 24 are selectively included in all the drivers 13B to 13L except the most upstream one. The absence of the signal input 24 in the most upstream first driver 13A does not cause an operational problem, because a judgement signal is not input from any one of the other drivers 13B to 13L to the first driver 13A. The configuration in which the signal inputs 24 are selectively included in in all the drivers 13B to 13L except the most upstream driver advantageously simplifies the overall structure.

Furthermore, the method of inspecting the liquid crystal display device 10 according to this embodiment is a method of inspecting the liquid crystal display device 10 including at least the liquid crystal panel 11 that displays an image and the drivers 13 that drive the liquid crystal panel 11. The method includes the first inspection process including generating a judgement signal in sequence at each of the drivers 13 with the switches 22 that are located between the drivers 13 adjacent to each other in the upstream and downstream direction to cascade the drivers 13 being set such that signal inputs 24 of at least all the drivers 13 except a most upstream one of the drivers 13 are connected to the judgement signal outputs 23 of the drivers 13 through which the judgement signals generated at the drivers 13 are output and determining whether the drivers 13 include a defective one based on whether the timing controller 21 connected at least to the judgment signal output 23 of the twelfth driver 13L, which is the most downstream driver 13, receives the judgment signal, and the second inspection process of identifying the defective driver 13 if it is determined that the drivers 13 include a defective one in first inspection process, the second inspection process including supplying an inspection signal from the inspection signal output 25 to the signal input 24 of one of the drivers 13 to be inspected, with one of the switches 22 corresponding to the driver 13 to be inspected being set such that the inspection signal output 25 configured to output the inspection signal is connected to the signal input 24 of the driver 13 to be inspected and the other switches 22 corresponding to the display drivers 13 not to be inspected being set such that the judgement signal outputs 23 are connected to the signal inputs 24 of the drivers 13 not to be inspected, such that the judgement signal is output from the judgement signal output 23 of the driver 13 being inspected in response to the inspection signal, generating a judgement signal in sequence at each of the other of the drivers 13 on a downstream side of the driver 13 being inspected in response to the judgement signal, and identifying the defective one of the drivers 13 based on whether the timing controller 21 receives the judgment signal at least from the judgement signal output 23 of the most downstream twelfth driver 13.

In the first inspection process, all the switches 22 are set such that the signal inputs 24 are connected to the judgement signal outputs 23. In such a state, when the most upstream first driver 13A of the drivers 13 generates a judgement signal, the judgement signal is output through the judgement signal output 23 of the first driver 13A to the signal input 24 of the next second driver 13B through the first switch 22A. When the judgement signal is input to the signal input 24 of the second driver 13B, the second driver 13B generates a judgement signal and outputs the signal through the judgement signal output 23 thereof. When all the drivers 13, which are cascaded by the switches 22, are free from defects, the most downstream twelfth driver 13L outputs a judgement signal to the timing controller 21. In contrast, if the drivers 13 include a defective one, the most downstream twelfth driver 13L does not output a judgement signal, and thus the timing controller 21 does not receive a judgement signal. The timing controller 21 determines that the drivers 13 do not include a defective one when the timing controller 21 receives a judgement signal and determines that the drivers 13 include a defective one when the timing controller 21 does not receive a judgement signal.

If it is determined that the drivers 13 include a defective one in the first inspection process, the second inspection process is performed next. In the second inspection process, the switch 22 for the driver 13 to be inspected is set such that the signal input 24 of the driver 13 to be inspected is connected to the inspection signal output 25 and the other switches 22 for the drivers 13 not to be inspected are set such that the signal inputs 24 of the drivers 13 not to be inspected are connected to the judgement signal outputs 23. In such a state, an inspection signal is sent from the inspection signal output 25 to the signal input 24 of the driver 13 to be inspected. At this time, when the driver 13 being inspected does not have a defect and all the other drivers 13 on the downstream side of the driver 13 being inspected does not have a defect, each of the drivers 13 generates a judgement signal. Thus, the most downstream twelfth driver 13L outputs the judgement signal through the judgement signal output 23. Although the driver 13 being inspected does not have a defect and the driver 13 outputs a judgement signal through the judgement signal output 23, the other drivers 13 on the downstream side may include a defective driver. In such a case, the most downstream twelfth driver 13L does not output a judgement signal through the judgement signal output 23. Furthermore, when the driver 13 being inspected has a defect, the defective driver 13 does not output a judgement signal through the judgement signal output 23, and thus the most downstream twelfth driver 13L does not output a judgement signal through the judgement signal output 23. In this configuration, the second inspection process is sequentially performed in descending order from the most upstream first driver 13A, for example, and when the timing controller 21 receives a judgement signal from the judgement signal output 23 of the most downstream twelfth driver 13L during inspection of one of the drivers 13, it is determined that the driver 13 on the upstream side of the inspected driver 13 has a defect. In this way, the defective driver 13 in the drivers 13 is identified.

Second Embodiment

A second embodiment is described with reference to FIG. 6 to FIG. 10. The second embodiment further includes a second switch 26. The same components, effects, and advantages as those in the first embodiment are not repeatedly described.

Figure 6:
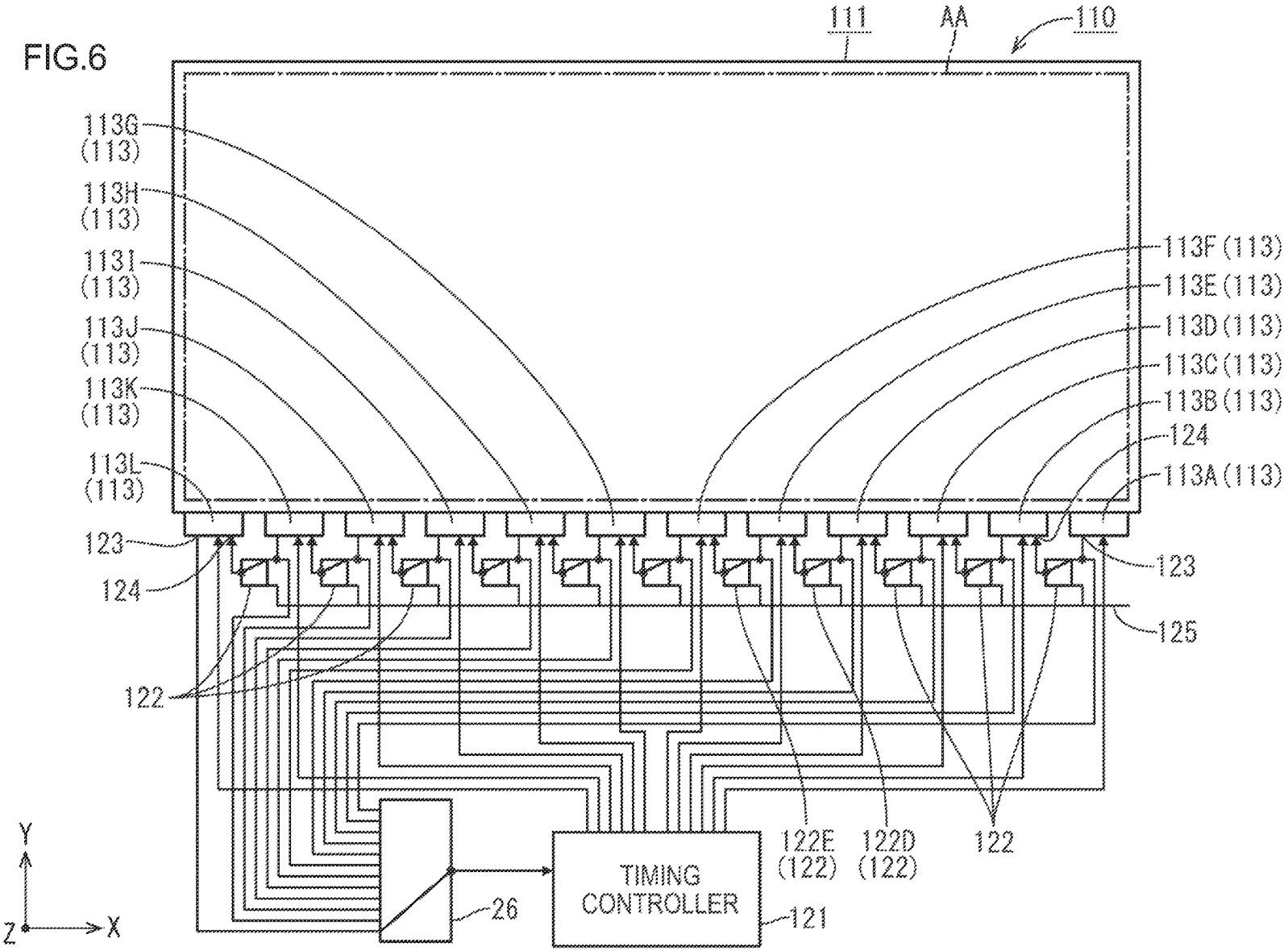
FIG. 6 illustrates an electrical connection between drivers included in a liquid crystal display device according to a second embodiment.

As illustrated in FIG. 6, a liquid crystal display device 110 according to the embodiment includes the second switch 26 connected to judgement signal outputs 123 of drivers 113 and to a timing controller 121. The second switch 26 switches the judgement signal outputs 123 connected to the timing controller 121. Specifically described, the second switch 26 is a single pole double throw switch having a common contact connected to the timing controller 121 and contacts (hereinafter, referred to as switching contacts for convenience) connected to the judgement signal outputs 123 of the drivers 113. The switching contacts are switchably connected to the common contact. The number of switching contacts in the second switch 26 is the same as the number of drivers 113. Thus, when a specific one of the switching contacts is connected to the common contact by operation of the second switch 26, the judgement signal output 123 of a specific one of the drivers 113 and the timing controller 121 are electrically connected to each other. The second switch 26 may be included in the printed circuit board or the control board.

A second inspection process included in the method of inspecting the liquid crystal display device 110 is described.

Figure 7:
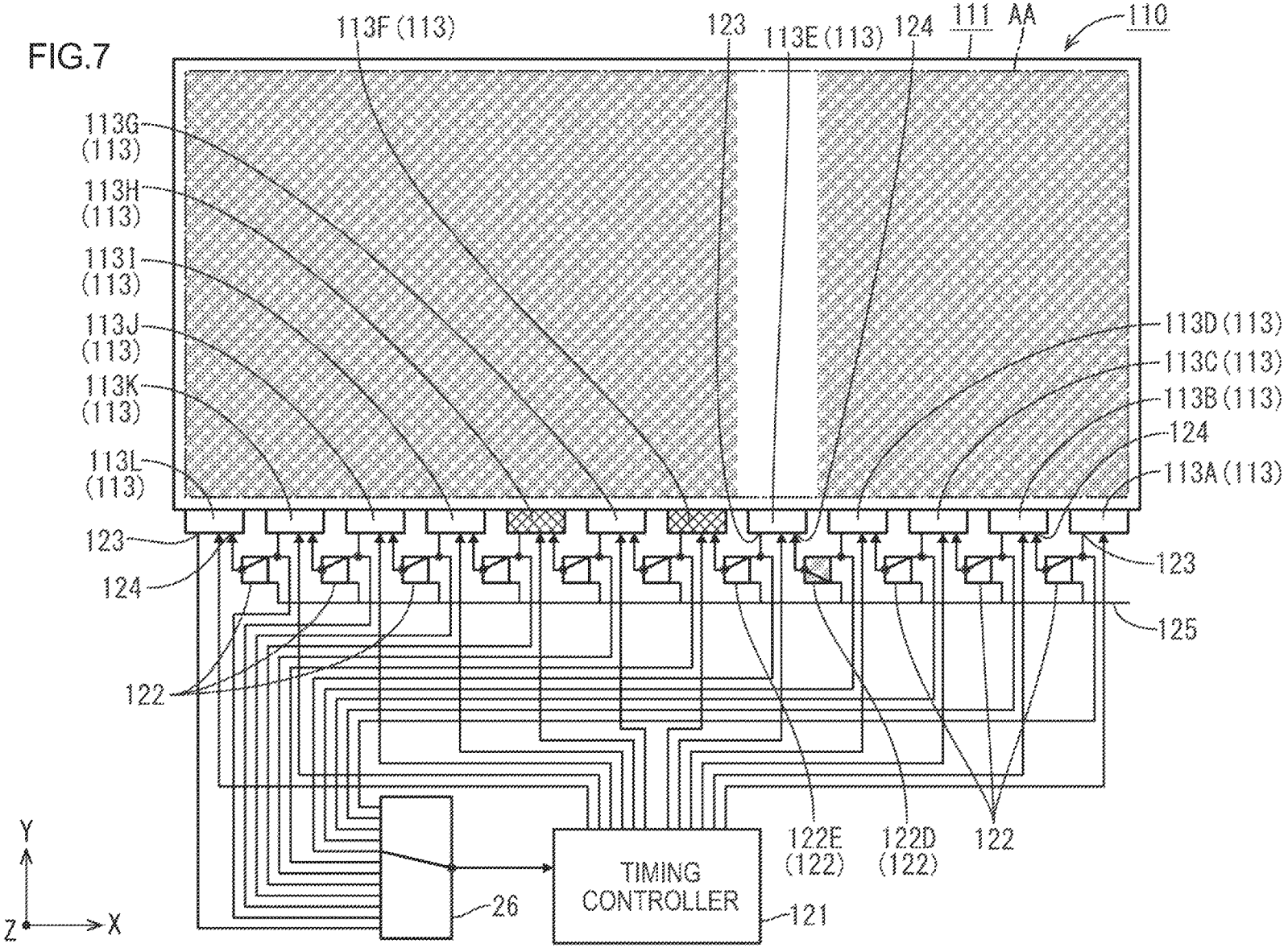
FIG. 7 illustrates how a fifth driver not having a defect is inspected in the second inspection process included in the method of inspecting a liquid crystal display device.

In one example illustrated in FIG. 7, a sixth driver 113F and an eighth driver 113H are defective drivers. In the second inspection process, the switch 122 for the driver 113 to be inspected is set such that the contact a (inspection signal output 125) is connected to the common contact, which is connected to the signal input 124 of the driver 113 to be inspected. In contrast, the second switch 26 is set such that the switching contact connected to the judgement signal output 123 of the driver 113 to be inspected is connected to the common contact connected to the timing controller 121. The switches 122 for the drivers 113 not to be inspected are set such that the contacts b (judgement signal outputs 123) are connected to the common contacts, which are connected to the signal inputs 124 of the drivers 113 not to be inspected. Specifically described, when the fifth driver 113E is inspected, for example, as illustrated in FIG. 7, the fourth switch 122D is set such that the contact a (inspection signal output 125) is connected to the common contact, which is connected to the signal input 124 of the fifth driver 113E. In contrast, the second switch 26 is set such that the switching contact, which is connected to the judgement signal output 123 of the fifth driver 113E, is connected to the common contact. In such a state, an inspection signal from the inspection signal output 125 is sent to the contact a of the fourth switch 122D and then is input to the signal input 124 of the fifth driver 113E through the common contact. Then, the fifth driver 113E generates a judgment signal. The fifth driver 113E outputs the judgement signal through the judgement signal output 123 to the timing controller 121 through the switching contact and the common contact of the second switch 26. The timing controller 121 that has received the judgement signal supplies various display signals to the fifth driver 113E that generated the judgement signal, allowing a band-like region of the display area AA allocated to the fifth driver 113E to provide a white display. The operator, who sees the white band-like region of the display area AA, knows that the driver 113 for the band-like region (fifth driver 113E in this case) does not have a defect.

Figure 8:
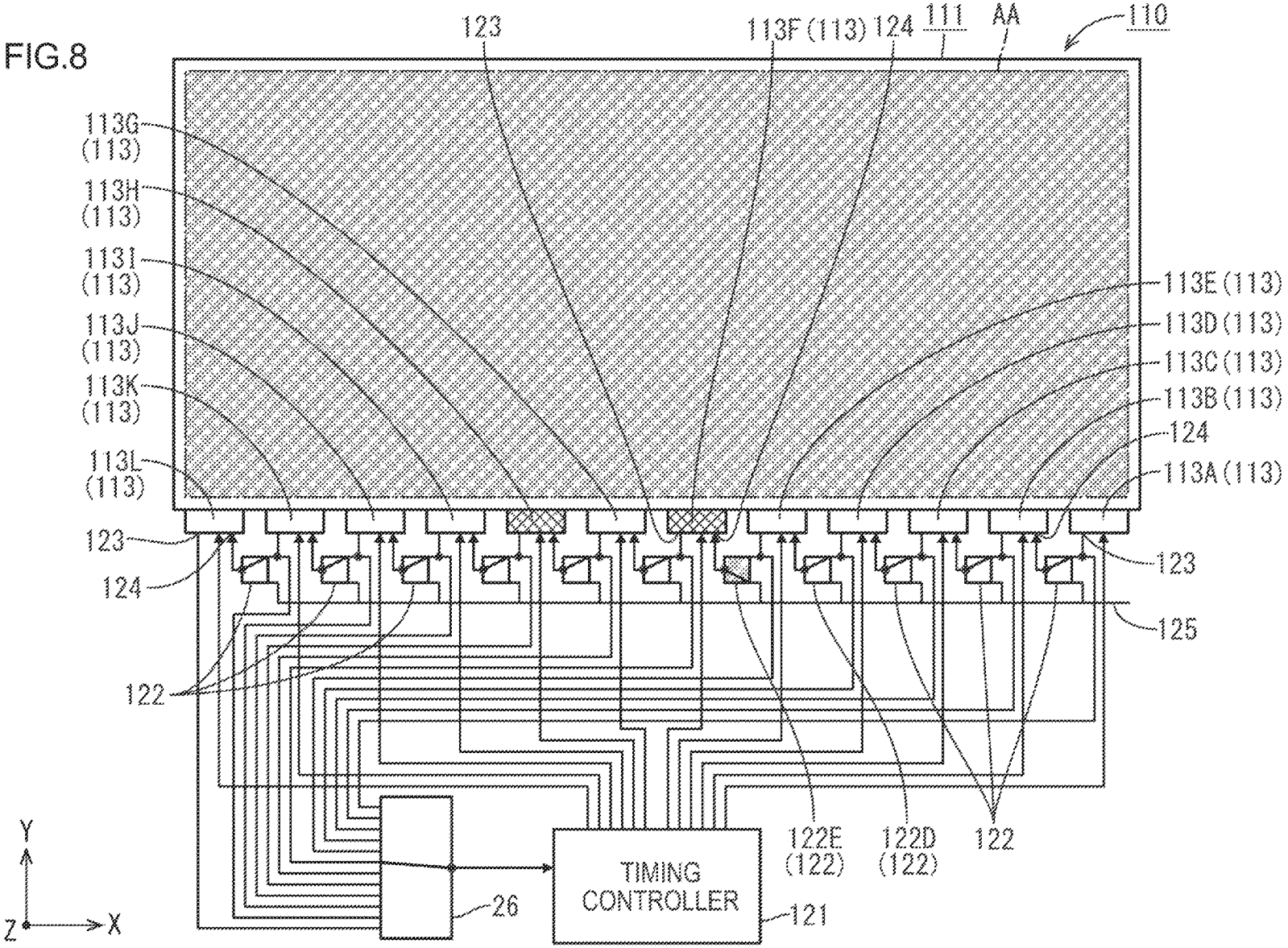
FIG. 8 illustrates how a defective sixth driver is inspected in the second inspection process included in the method of inspecting a liquid crystal display device.

Next, in the second inspection process for the sixth driver 113F, as illustrated in FIG. 8, the fifth switch 122E is set such that the contact a (inspection signal output 125) is connected to the common contact, which is connected to the signal input 124 of the sixth driver 113F. In contrast, the second switch 26 is set such that the switching contact, which is connected to the judgement signal output 123 of the sixth driver 113F, is connected to the common contact. In such a state, an inspection signal from the inspection signal output 125 is input to the contact a of the fifth switch 122E and then is input to the signal input 124 of the sixth driver 113F through the common contact. At this time, the sixth driver 113F does not generate a judgement signal. Thus, a judgement signal is not input to the switching contact of the second switch 26, and thus the timing controller 121 does not receive a judgement signal. The timing controller 121 does not supply various display signals to the sixth driver 113F that does not generate a judgement signal, and thus the band-like region of the display area AA allocated to the sixth driver 113F provides a black display like the band-like regions allocated to the drivers 113A to 113E and 113G to 113L. The operator, who sees the black display over the entire display area AA, knows that the driver 113 being inspected (sixth driver 113F in this case) has a defect.

Figure 9:
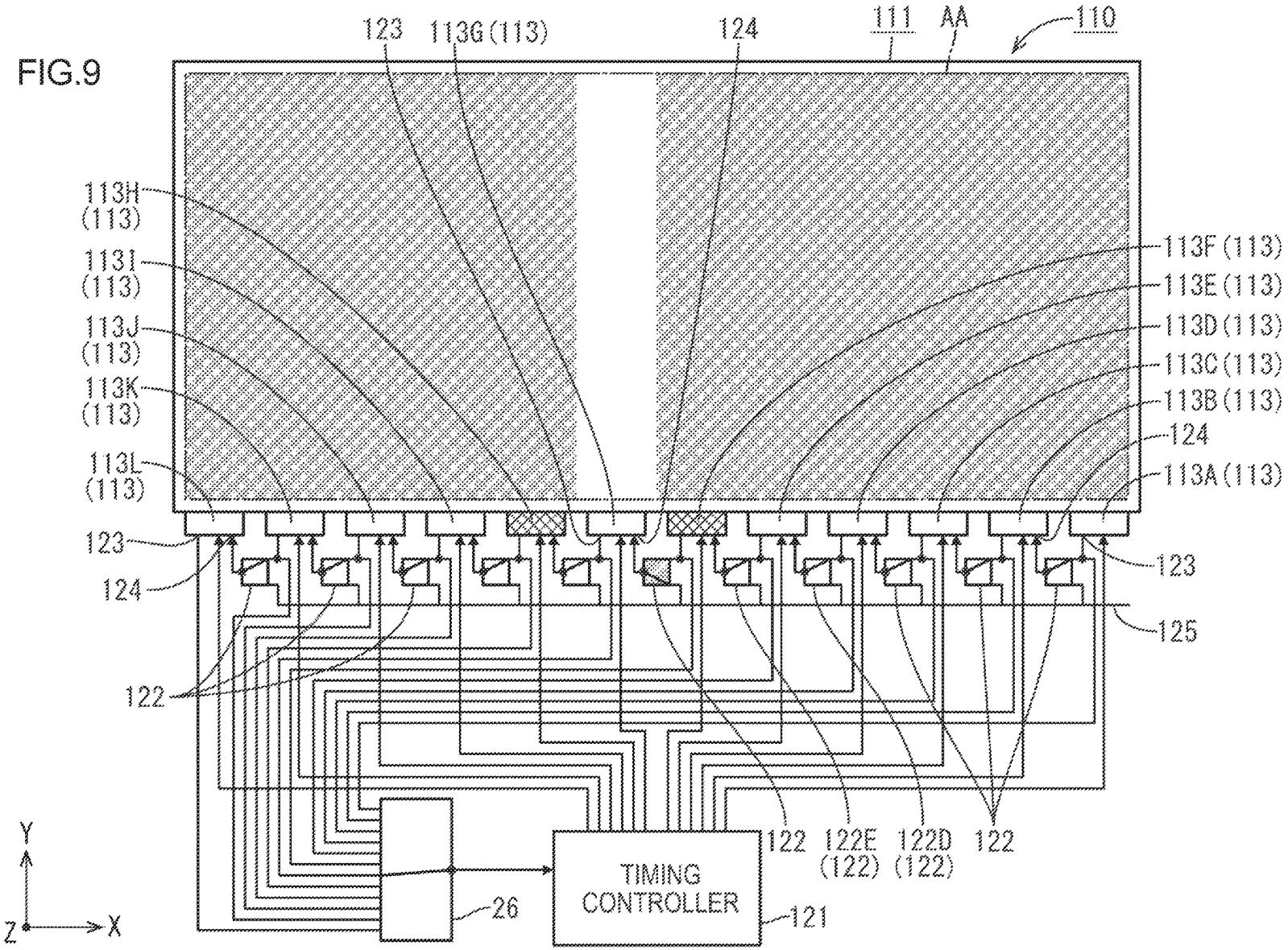
FIG. 9 illustrates how a seventh driver not having a defect is inspected in the second inspection process included in the method of inspecting a liquid crystal display device.
Figure 10:
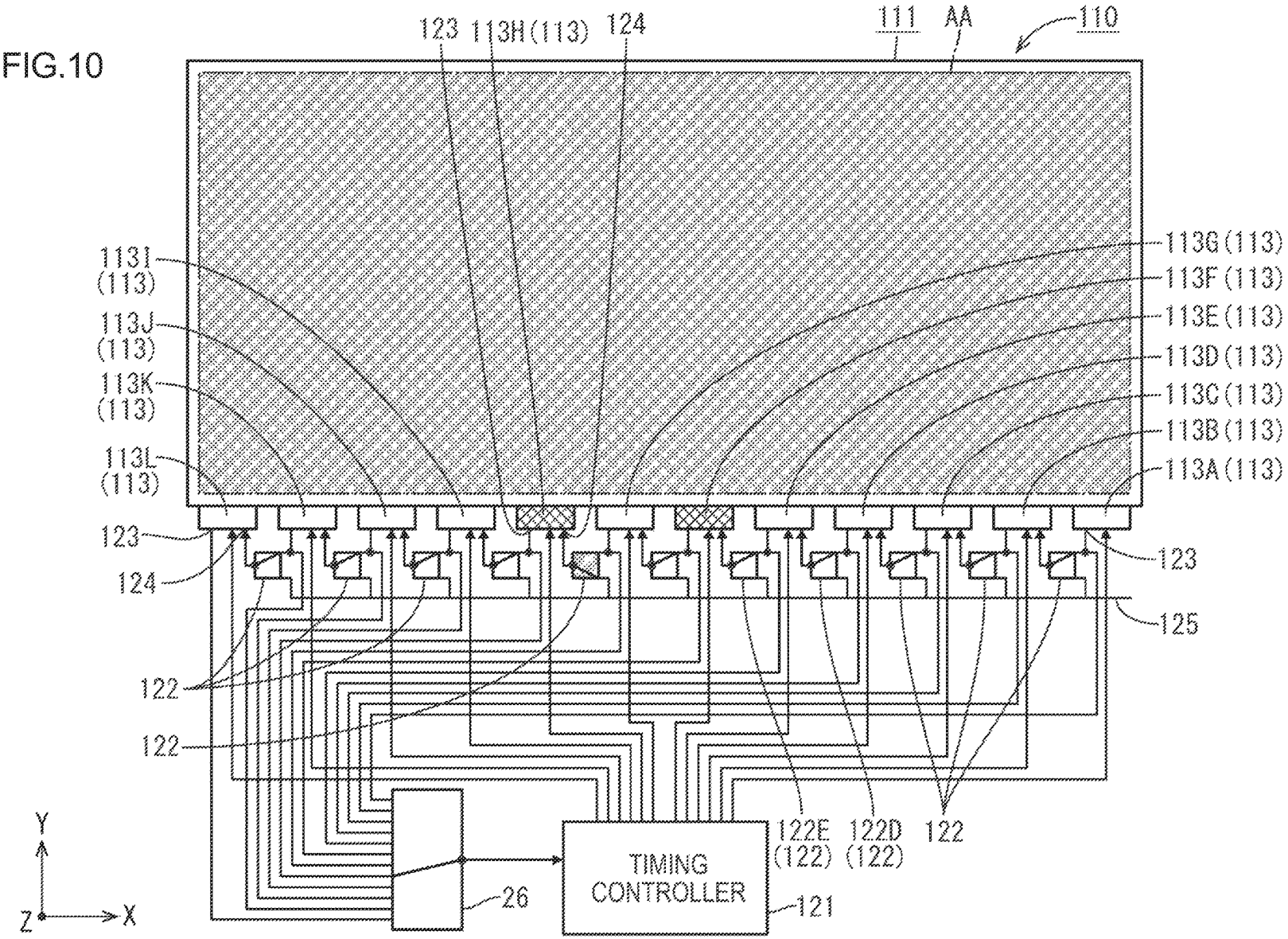
FIG. 10 illustrates how a defective eighth driver is inspected in the second inspection process included in the method of inspecting a liquid crystal display device.

Next, the second inspection process for the seventh driver 113G is performed in the same way as that for the fifth driver 113E. As illustrated in FIG. 9, the operator who sees the white band-like region of the display area AA allocated to the seventh driver 113G knows that the driver 113 (seventh driver 113G in this case) does not have a defect. Here, if the sixth driver 13F and the eighth driver 13H are defective drivers in the configuration described in the first embodiment (not including the second switch 26), the second inspection process is performed on the seventh driver 13G. In the inspection, the defective eighth driver 13H does not generate a judgement signal, and thus the entire display area AA provides a black display (see FIG. 3). In other words, the configuration of the first embodiment is able to detect a defect in the eighth driver 13H, which is the downstream one of the sixth and eighth drivers 13F and 13H, but is not able to detect a defect in the sixth driver 13F. Furthermore, it is not detectable which one of the drivers 13 on the upstream side of the eighth driver 13H (first to seventh drivers 13A to 13G) is the defective driver. In contrast, in the second embodiment, the second inspection process is performed on each of the drivers 113, and thus if two or more drivers have a defect, the defective drivers 113 are properly identified. Specifically described, the second inspection process for the eighth driver 113H is performed in the same way as that for the sixth driver 113F. As illustrated in FIG. 10, the operator who sees a black display over the entire display area AA knows that the driver 113 being inspected (eighth driver 113H in this case) has a defect.

When the second inspection process is performed on the first drivers 113A to the fourth drivers 113D and the ninth driver 113I to the twelfth driver 113L, which are free from defects as the fifth and seventh drivers 113E and 113G, the band-like regions of the display area AA allocated to the drivers 113A to 113D, 113I to 113L each provide a white display.

As described above, the second embodiment includes the second switch 26 that is connected to the judgment signal outputs of the drivers 113 and to the timing controller 121 to switch the judgement signal outputs 123 connected to the timing controller 121. In the inspection for identifying the defective driver 113 in the drivers 113, the switch 122 is set such that the inspection signal output 125 is connected to the signal input 124 of the driver 113 to be inspected and the second switch 26 is set such that the judgement signal output 123 of the driver 113 to be inspected is connected to the timing controller 121. When the driver 113 being inspected does not have a defect, the inspection signal from the inspection signal output 125 is input to the signal input 124 through the switch 122, and then the driver 113 generates a judgement signal. The judgement signal is output through the judgement signal output 123 to the timing controller 121 through the second switch 26. In contrast, when the driver 113 being inspected has a defect, the driver 113 does not generate a judgment signal although the inspection signal from the inspection signal output 125 is input to the signal input 124 through the switch 122. Thus, the timing controller 121 does not receive a judgement signal. In this way, the drivers 113 are separately subjected to the inspection. When the drivers 113 include two or more defective drivers 113, the defective drivers 113 are properly identified.

Furthermore, the timing controller 121 controls driving of the drivers 113 based on whether the timing controller 121 receives a judgment signal from the judgement signal output 123 of each of the drivers 113. In this configuration, when the timing controller 121 receives a judgement signal from the judgement signal output 123 of one of the drivers 113 being inspected, the timing controller 121 drives the driver 113 including the judgement signal output 123 through which the judgement signal was output. Thus, an image is displayed on the liquid crystal panel 111 over a predetermined area by the driver 113. In contrast, when a judgement signal is not output from the judgement signal output 123 of the inspected driver 113, the timing controller 121 does not receive a judgement signal. Thus, the timing controller 121 does not drive all the drivers 113. In such a case, an image is not displayed on the liquid crystal panel 111. As described above, the operator knows whether the driver 113 has a defect based on whether an image is displayed on the liquid crystal panel 111. Furthermore, the operator knows which driver 113 has a defect based on the area of the image displayed on the liquid crystal panel.

Third Embodiment

A third embodiment is described with reference to FIG. 11. In the third embodiment, a second switch 226 is different from that in the second embodiment. The same components, effects, and advantages as those in the second embodiment are not repeatedly described.

Figure 11:
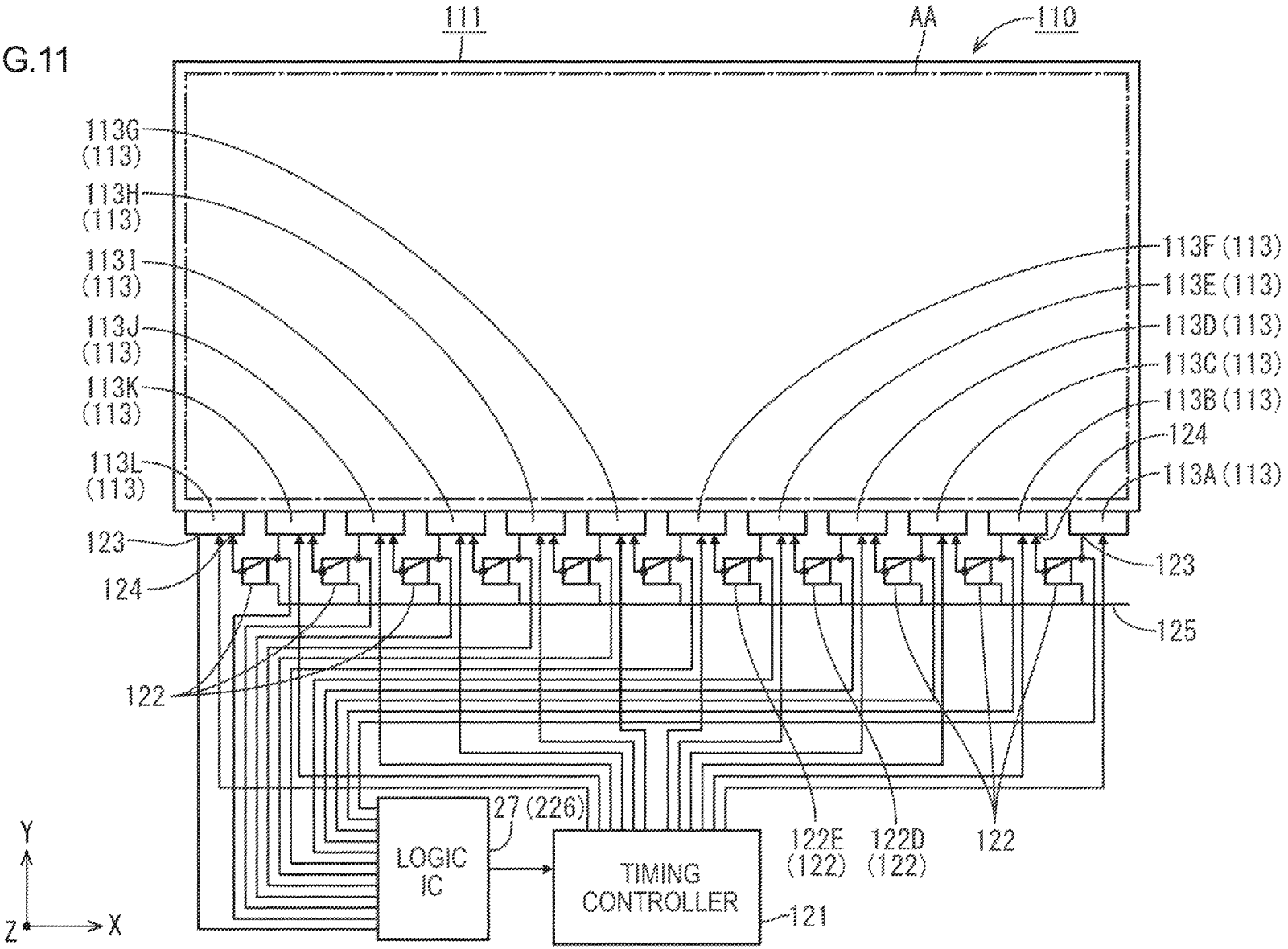
FIG. 11 illustrates an electrical connection between drivers included in a liquid crystal display device according to a third embodiment.

As illustrated in FIG. 11, the second switch 226 of the embodiment includes a logic IC 27 instead of the mechanical switch described in the second embodiment. In this configuration, an external computer such as a PC connected to the logic IC 27 executes switching of the second switch 226 including the logic IC 27. This simplifies the inspection process, leading to an improvement in performance, for example.

Fourth Embodiment

A fourth embodiment is described with reference to FIG. 12. In the fourth embodiment, an inspection signal output 325, switches 322, and a timing controller 321 are disposed in a way different from that in the first embodiment. The same components, effects, and advantages as those in the first embodiment are not repeatedly described.

Figure 12:
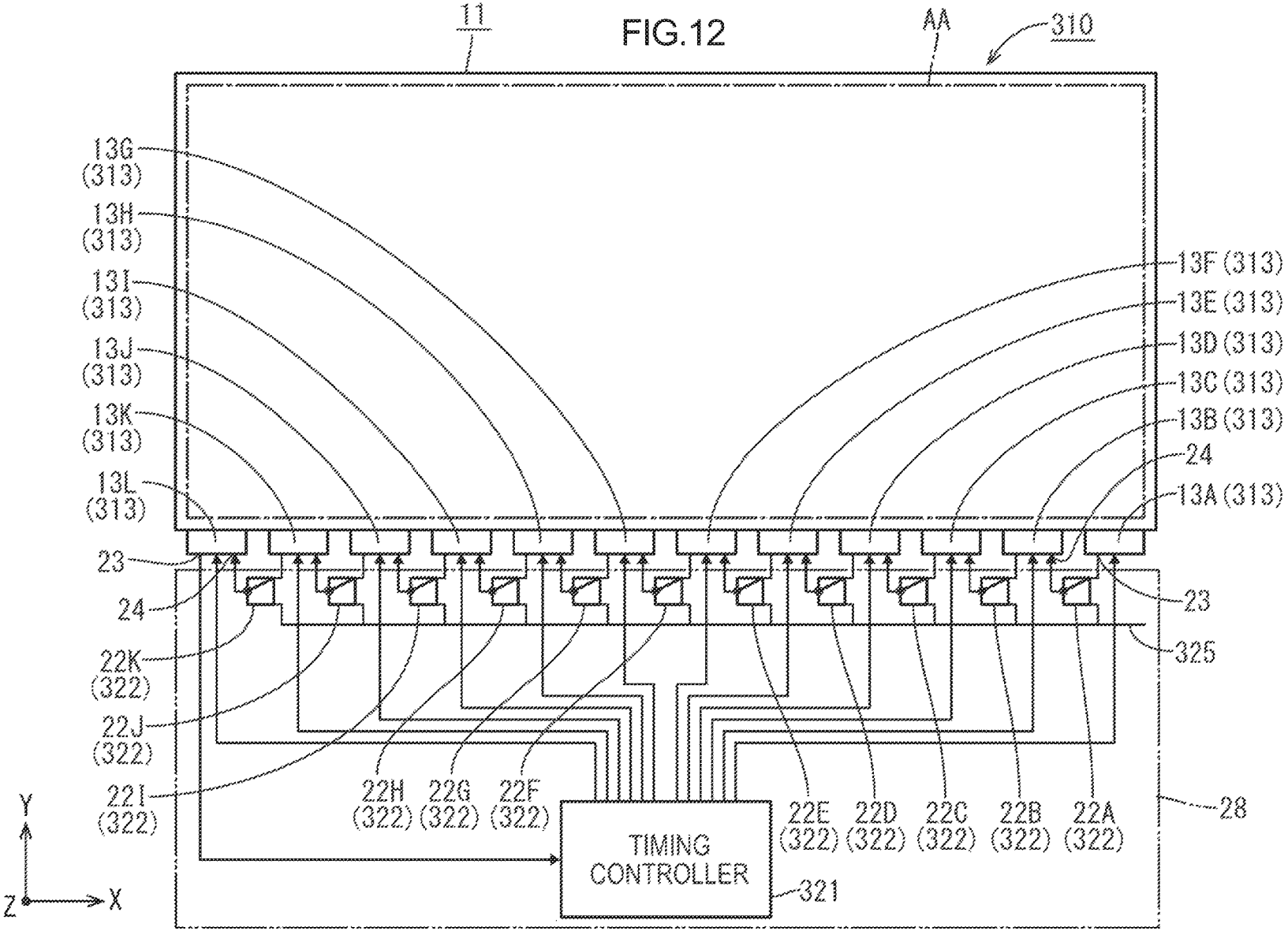
FIG. 12 illustrates an electrical connection between drivers included in a liquid crystal display device according to a fourth embodiment.

As illustrated in FIG. 12, the inspection signal output 325, the switches 322, and the timing controller 321 of this embodiment are included in an inspection device 28, which is an external device independent from the liquid crystal display device 310. The inspection device 28 is used to inspect the liquid crystal display device 310 during the manufacture and is not placed on the market as a component of the liquid crystal display device 310. The inspection device 28 is connected to the liquid crystal display device 310 when the first inspection process and the second inspection process are performed in the manufacturing of the liquid crystal display device 310. The details of the first and second inspection processes are as described above in the first embodiment. This allows the liquid crystal display device 310 to have a simpler structure than the liquid crystal display device 10 in the first embodiment including the inspection signal output 25, the switches 22, and the timing controller 21, which is described in the first embodiment (FIG. 3). Furthermore, this configuration permits more freedom in the design of the inspection device 28, advantageously improving the inspection efficiency, for example. Furthermore, the inspection device 28 is able to be repeatedly used to inspect multiple liquid crystal display devices 310, contributing to a reduction in the cost. The liquid crystal display device 310 includes a timing controller that drives the drivers 313 in addition to the timing controller 321.

As described above, in the method of inspecting the liquid crystal display device 310 according to the embodiment, the inspection device 28, which includes at least the inspection signal output 325, the switches 322, and the timing controller 321, is connected to the liquid crystal display device 310 to perform the first and second inspection processes. In this configuration, the first and second inspection processes are performed with the inspection device 28, which includes at least the inspection signal output 325, the switches 322, and the timing controller 321, being connected to the liquid crystal display device 310. This configuration allows the liquid crystal display device 310 to have a simpler structure than the structure of the liquid crystal display device 10 including the inspection signal output 25, the switches 22, and the timing controller 21. Furthermore, this configuration permits more freedom in design of the inspection device 28, advantageously improving the inspection efficiency, for example. Furthermore, the inspection device 28 is able to be repeatedly used to inspect multiple liquid crystal display devices 310, contributing to a reduction in cost.

OTHER EMBODIMENTS

The present technology is not limited to the embodiments described above and with reference to the drawings. The following embodiments may be included in the technical scope of the present technology, for example.

(1) In the above-described embodiments, the second inspection process is performed in descending order from the most upstream driver. However, the second inspection process may be performed in ascending order from the most downstream driver, for example. Other than the above, the driver that is subjected to the second inspection process first may be suitably changed.

(2) The configuration in the fourth embodiment that is based on the configuration in the first embodiment may be based on that in the second or third embodiment. In such a case, the inspection device includes a second switch in addition to the inspection signal output, the switches, and the timing controller.

(3) In the above-described embodiments (except the fourth embodiment), the inspection signal output and the switches are disposed on the printed circuit board. However, the inspection signal output and the switches may be disposed on the array substrate (CF substrate non-overlapping portion) of the liquid crystal panel.

(4) In the above-described embodiments, the timing controller functions as a "judgement unit", which receives a judgement signal. However, a judgement unit may be a separate component from the timing controller. In such a case, the judgement unit may be disposed on the control board, the printed circuit board, or the array substrate (CF substrate non-overlapping portion) of the liquid crystal panel, for example.

(5) In the inspection method described in the above-described embodiments, the driver that has generated a judgment signal is driven by the timing controller to display an image on the liquid crystal panel. However, when the inspection is performed by using an external inspection device as in the fourth embodiment, not a liquid crystal panel of the liquid crystal display device being inspected but a display panel of the inspection device may display an image in the inspection. Furthermore, the inspection may be performed without displaying an image on the display panel of the inspection device, too.

(6) The specific configuration of the switch and the second switch may be suitably changed from those in the above-described embodiments.

(7) In the above-described embodiments, the drivers are mounted on the flexible boards by using COF technology. However, the drivers may be mounted on the CF substrate non-overlapping portion of the array substrate by using chip on glass (COG) technology.

(8) In the above-described embodiments, all the flexible boards are mounted on one printed circuit board. However, the number of printed circuit boards may be two or more such that a predetermined number of flexible boards is mounted on each of the printed circuit boards.

(9) In the above-described embodiments, the number of drivers and the number of flexible boards are each twelve. However, the specific numbers of drivers and flexible boards may be suitably changed from twelve. In such a case, the number of switches may be suitably changed from eleven.

(10) In the above-described embodiments, the liquid crystal panel is a transmissive liquid crystal panel. However, the liquid crystal panel may be a reflective liquid crystal panel or a semi-transmissive liquid crystal panel.

(11) The shape of the liquid crystal panel in a plan view may be a vertically-elongated rectangle, a square, a circle, a semicircle, an oval, an ellipse, or a trapezoid, for example, other than the shape in the above-described embodiments.

(12) A display panel including functional organic molecules other than the liquid crystal material between two substrates may be used other than that in the above-described embodiments.

(13) In the above embodiments, the liquid crystal display device includes a liquid crystal panel. However, the display device may include another type of display panel, such as an organic EL panel, a plasma display panel (PDP), or a microcapsule electrophoretic display panel (EPD), or a micro electromechanical system (MEMS) display panel.

The invention claimed is:

1. A display device comprising:

a display panel including a display area capable of displaying an image;

a first display driver configured to drive a first region of the display area, the first display driver being configured to generate a first judgement signal, the first display driver including:

a first signal input port through which signals are input; and a first judgement signal output port through which the first judgement signal is output;

a second display driver configured to drive a second region of the display area, the second display driver being configured to generate a second judgement signal, the second display driver including:

a second signal input port through which at least the first judgement signal is input; and a second judgement signal output port through which the second judgement signal is output;

a third display driver configured to drive a third region of the display area, the third display driver being configured to generate a third judgement signal, the third display driver including:

a third signal input port through which at least the second judgement signal is input; and a third judgment signal output port through which the third judgement signal is output;

an inspection signal generator configured to generate a first inspection signal and a second inspection signal;

a plurality of switches connecting the first display driver, the second display driver, and the third display driver in cascade and to the inspection signal generator, wherein the plurality of switches include:

a first switch including:

a first contact connected to the inspection signal generator to input the first inspection signal to the second display driver;

a second contact connected to the first judgement signal output port of the first display driver uppermost in cascade connection among the first display driver, the second display driver, and third display driver to input the first judgement signal to the second display driver; and a first common contact connected to the first contact, the second contact, and the second signal input port of the second display driver second uppermost in the cascade connection to input any one of the first inspection signal and the first judgement signal to the second display driver; and a second switch including:

a third contact connected to the inspection signal generator to input the second inspection signal to the third display driver lowermost in the cascade connection;

a fourth contact connected to the second judgement signal output port of the second display driver to input the second judgement signal to the third display driver; and a second common contact connected to the third contact, the fourth contact, and the third signal input port of the third display driver to input any one of the second inspection signal and the second judgement signal to the third display driver; and a controller connected to the first signal input port and the third judgement signal output port, the controller being configured to:

control the first switch to electrically connect the first common contact to the second contact to input the first judgement signal to the second display driver;

control the second switch to electrically connect the second common contact to the fourth contact to input the second judgement signal to the third display driver; and determine whether the third judgement signal from the third display driver is input.

2. The display device according to claim 1, wherein the second display driver is configured to generate the second judgement signal when the first judgement signal is input through the second signal input port, and the third display driver is configured to generate the third judgement signal when the second judgement signal is input through the third signal input port.

3. The display device according to claim 1, wherein if the third judgement signal is not input, the controller is configured to control the first display driver, the second display driver, and the third display driver to stop driving of the first region, the second region, and the third region of the display area.

4. The display device according to claim 1, wherein the controller is configured to:

if the third judgement signal is not input, control the first switch to disconnect the first common contact from the second contact and electrically connect the first common contact to the first contact to input the first inspection signal to the second display driver through the second signal input port;

determine whether the third judgement signal from the third display driver is input;

if the third judgement signal is input, determine the first display driver is defective; and if the third judgement signal is not input, control the second switch to disconnect the second common contact from the fourth contact and electrically connect the second common contact to the third contact to input the second inspection signal to the third display driver through the third signal input port; and determine whether the third judgement signal is input;

if the third judgement signal is input, determine the second display driver is defective.

5. The display device according to claim 4, wherein the second display driver is configured to generate the second judgement signal when the first inspection signal is input, and the third display driver is configured to generate the third judgement signal when the second inspection signal is input.

6. The display device according to claim 4, wherein the controller is configured to:

control the first display driver and the second display driver to stop driving of the first region and the second region of the display area; and control the third display driver to drive the third region of the display area.

7. The display device according to claim 6, wherein the display panel is configured to exhibit black in the first region and the second region, and the display panel is configured to exhibit white in the third region.

* * * * *